US005994278A

United States Patent [19]

Duncan et al.

[11] Patent Number: 5,994,278

[45] **Date of Patent: *Nov. 30, 1999**

[54] BLENDS OF LUBRICANT BASESTOCKS WITH HIGH VISCOSITY COMPLEX ALCOHOL ESTERS

[75] Inventors: Carolyn Boggus Duncan; David Wayne Turner, both of Baton Rouge, La.

[73] Assignee: Exxon Chemical Patents Inc., Houston, Tex.

[ * ] Notice: This patent is subject to a terminal disclaimer.

[21] Appl. No.: 08/799,013

[22] Filed: Feb. 7, 1997

Related U.S. Application Data

[60] Provisional application No. 60/025,596, Sep. 6, 1996.

[51] Int. Cl.[6] ..... C01M 129/70; C01M 129/74

[52] U.S. Cl. ..... 508/485; 508/491; 508/493; 508/591; 508/202; 508/433

[58] Field of Search ..... 508/492, 485, 508/491, 493, 591, 202, 433

[56] References Cited

U.S. PATENT DOCUMENTS

| | | | |
|---|---|---|---|
| 2,628,974 | 2/1953 | Sanderson . | |
| 2,805,247 | 9/1957 | Krichai . | |
| 3,016,353 | 1/1962 | Matuszak . | |
| 3,048,623 | 8/1962 | Matuszak et al. . | |
| 3,194,764 | 7/1965 | Ovist et al. . | |
| 3,202,701 | 8/1965 | Young et al. . | |
| 3,278,586 | 10/1966 | Ovist et al. . | |
| 3,377,377 | 4/1968 | Kluge . | |
| 3,956,200 | 5/1976 | Riem et al. . | |
| 3,984,445 | 10/1976 | Takeo et al. . | |
| 4,036,771 | 7/1977 | Denis et al. . | |
| 4,064,058 | 12/1977 | Walker . | |
| 4,155,861 | 5/1979 | Schmitt et al. | 252/56 S |
| 5,372,736 | 12/1994 | Trivett | 252/56 R |
| 5,560,850 | 10/1996 | Hoppe et al. | 508/485 |
| 5,658,863 | 8/1997 | Duncan et al. | 508/485 |
| 5,750,750 | 5/1998 | Duncan et al. | 508/485 |

FOREIGN PATENT DOCUMENTS

| | | |
|---|---|---|
| 736513 | 6/1966 | Canada . |
| 182526 | 5/1986 | European Pat. Off. . |
| 0 335 013 | 10/1989 | European Pat. Off. . |
| 0 568 348 | 11/1993 | European Pat. Off. . |
| 2307867 | 11/1976 | France . |
| 2511905 | 9/1975 | Germany . |
| 70004740 | 1/1965 | Japan . |
| 72042821 | 10/1972 | Japan . |
| 60-045547 | 3/1985 | Japan . |
| 60-056657 | 3/1985 | Japan . |
| 62-045561 | 2/1987 | Japan . |
| 63-107947 | 5/1988 | Japan . |
| 03217493 | 9/1991 | Japan . |
| 05025484 | 2/1993 | Japan . |
| 06025682 | 2/1994 | Japan . |
| 06025683 | 2/1994 | Japan . |
| 7330670 | 12/1995 | Japan . |
| 6408397 | 1/1966 | Netherlands . |
| 1060750 | 3/1967 | United Kingdom . |
| 1460665 | 6/1977 | United Kingdom . |
| 1526825 | 10/1978 | United Kingdom . |

OTHER PUBLICATIONS

Liquid Compositions Containing Carboxylic (poly)esters; Industrial Organic Chemicals, Leather, Fats and Waxes, Date Unknown.

Multisensor array for pH, Potassium(1+), sodium(1+) and calcium(2+) Measurements based on Coated–film Electrodes; Inorganic Analytical Chemistry, Date Unknown.

Study of the Surface Activity of Dialkyl Disulfossuccinoethane Salts; Surface Active Agents and Detergents, Date Unknown.

Multisensor Aray for pH, Potassium(1+); Sodium(1+) and Calcium(2+) Measurements Based on Coated–film Electrodes; Inorganic Analytical Chemistry, Date Unknown.

Study of the Surface Activity of Dialkyl Disulfosuccionoethane Salts; Plastics Manufacture and Processing, Date Unknown.

Polyester Plasticizers Containing Trimellitate Ester Mixtures; Plastics Manufacture and Processing, Date Unknown.

Lubricants Containing Crosslinked Esters for Processing Thermoplastic Synthetic Fibers; Textiles and Fibers, Date Unknown.

Lubricants Containing Ester–Olefin Reaction Products for Processing Thermoplastic Synthetic Fibers; Textiles and Fibers, Date Unknown.

Lubricants Containing Ester Polymers for Processing Thermoplastic Synthetic Fibers; Textiles and Fibers, Date Unknown.

(List continued on next page.)

*Primary Examiner*—Margaret Medley
*Attorney, Agent, or Firm*—Blossom E. Loo

[57] ABSTRACT

A lubricating oil comprising an add mixture of the following components: (A) a complex alcohol ester basestock which comprises the reaction product of an add mixture of the following: (1) a polyhydroxyl compound represented by the general formula:

$$R(OH)_n$$

wherein R is any aliphatic or cyclo-aliphatic hydrocarbyl group and n is at least 2, provided that the hydrocarbyl group contains from about 2 to 20 carbon atoms; (2) a polybasic acid or an anhydride of a polybasic acid, provided that the ratio of equivalents of the polybasic acid to equivalents of alcohol from the polyhydroxyl compound is in the range between about 1.6:1 to 2:1; and (3) a monohydric alcohol, provided that the ratio of equivalents of the monohydric alcohol to equivalents of the polybasic acid is in the range between about 0.84:1 to 1.2:1; wherein the complex alcohol ester exhibits a viscosity in the range between about 100–700 cSt at 40° C. and having a polybasic acid ester concentration of less than or equal to 70 wt. %, based on the complex alcohol ester; and (B) at least one additional basestock.

19 Claims, No Drawings

OTHER PUBLICATIONS

Active Methylene Compounds and Receptors as Curing Systems for Coatings; Coatings, Inks, and Related Products, Date Unknown.
Stretchable Polyethylene Films; Plastics Manufacture and Processing, Date Unknown.
Potentiometric Method and Apparatus for Determining the Concentration Ratio of Lithium to Sodium Ions; Inorganic Analytical Chemistry, Date Unknown.
Dicarboxylic Acid Diamides, Method for Producing Them, Their Sodium Complexes, and Ion–Selective Components for Determining Sodium Complexes; Inorganic Analytical Chemistry, Date Unknown.
Photocured Polymers In Ion–selective Electrode Membranes, Part 1. A Potassium Electrode for Flow–Injection Analysis; Inorganic Analytical Chemistry, Date Unknown.
Stabilizers for Halogen–containing Polymers Comprising the Product of a Diorganotin Oxide, an Ethylenically Unsaturated Dicarboxylic Acid Ester and a Mercaptan; Plastics Manufacture and Processing, Date Unknown.
Esterification and/or Ester Interchange Catalyst; Industrial Organic Chemicals, Leather, Fats and Waxes, Date Unknown.
Bicarbonate–sensitive Electrode Based on Planar Thin Membrane Technology; Inorganic Analytical Chemistry, Date Unknown.
Selective transport Membranes and Their Applicability for Novel Sensors; Electrochemistry, Date Unknown.
Design of Neutral Hydrogen Ion Carriers for Solvent Polymeric Membrane Electrodes of Selected pH Range; Inorganic Analytical Chemistry, Date Unknown.
Radical Copolymerization of Ethylene Glycol Bis(methyl fumarate) with N–vinylcarbazole; Chemistry of Synthetic High Polymers, Date Unknown.
Stabilizers for PVC; Platics Manufacture and Processing, Date Unknown.
Bis(progargyloxymaleoyloxy)ethane as an Antiwear Additive for Spindle or Transformer Oil; Fossil Fuels, Derivatives, and Related Products, Date Unknown.
Fiber Finishing Agents; Textiles, Date Unknown.
Lubricant Finishes for Synthetic Fibers; Textiles, Date Unknown.
Reactive Oligomers. II. Polymerization of Glycol (bis–allylphthalate)s and Glycol bis(allyl succinate)s; Chemistry of Synthetic High Polymers, Date Unknown.
Synthesis of Vinyl Oligoesters; Chemistry of Synthetic High Polymers, Date Unknown.
Easily Crosslinkable Polymer Material; Plastics Manufacture and Processing, Date Unknown.
Readily–crosslinked Plastics; Plastics Manufacture and Processing, Date Unknown.
Foam Plastics; Plastics Manufacture and Processing, Date Unknown.
Synthesis of Unsaturated Polyesters Based on Dicyclopentadiene Derivatives; Plastics Manufacture and Processing, Date Unknown.
Plasticizers for Vinyl Polymers and Nylon 12; Plastics Manufacture and Processing, Date Unknown.
Poly(vinyl chloride) Mixture and Its Fcopolymers Restistant Against Organic Aliphatic Solvents, Oils and Low Temperature; Plastics Manufacture and Processing, Date Unknown.
Effect of Polyester Plasticizers on the Radiation Crosslinking of a PVC–triallyl Cyanurate Composition; Plastics Manufacture and Processing, Date Unknown.
Antifriction Grease; Petroleum, Petroleum Derivatives, and Related Products, Date Unknown.
Light–resistant Polypropylene Filaments; Textiles, Date Unknown.
2–Propynyl Bisesters; Noncondensed Aromatic Compounds, Date Unknown.
Novel Polyallyl Esters, Their Production and Use; Plastics Manufacture and Processing, Date Unknown.
Odorless Acrylic Adhesives; Plastics Fabrication and Uses, Date Unknown.
Copy of the International Search Report dated Jan. 13, 1998.
English Translation of French Patent No. 2,187,894.
Complex Esters As Antiwear Agents by Misra; et al., dated April 26, 1973, pp. 229–237.
*Journal of Applied Chemistry of the USSR*; Sep., 1972, vol. 45, No. 4, Part 2; 3 pages.
*Synthetic Lubricants And High–Performance Functional Fluids*, by Ronald L. Shubkin, pp. 41 & 64, Date Unknown.
Synthesis, Evaluation and Applications of Complex Esters As Lubricants: A Basic Study; by P.S. Venkataramani et al., JSL, pp. 271–289, Date Unknown.
A Route to Quantitative carbon–13 NMR Analysis Of Munticomponent Polyesters by Soeren Hvilsted; Makromol. Chem., Macromol. Symp. 1991, 177–184.
Carbon—NMR Analysis of Crosslinking Sites In Branched Polyesters by Soeren Hvilsted; Biol. Synth. Polym. Networks, 1988, 243–54.
Reactive Oligomers. 5. Polymerization of Ethylene Glycol Bis(isopropyl fumarate), ethylene glycol bis(n–butyl fumarate), and diethylene glycol bis(n–butyl fumarate by Akira Matsumoto et al.; J. Polym. Sci. Part a: Polym. Chem, 1988.
Reactive Oligomers. I. Preparation and Polymerization of Ethylene Glycol Bis(methyl fumarate); Akira Matsumoto et al.; J. Polym. Sci. Polym. Chem. Ed., 1983, 21(11).
Reactive Oligomers With Triple Bonds. II. Synthesis And Study of the Properties of Oligoester Propargyl Esters; S.G. Grigoryan et al; Am. Khim. Zh., 1979, 32(11), 911–14.
Effect of Number of Carboxyl Groups on Liquid Density of Esters of Alkylcarboxylic Acids; Joseph C. Phillips; J. Chem. Eng. Data, 1978, 23(1), 1–6.
Pyrolysis of poly(1,4–butylene adipatae); Francois Messier et al.; Can. J. Chem., 1977, 55(14), Correlation of Liquid Heat–Capacities for Carboxylic Esters; Joseph C. Phillips, et al.; J. Chem. Eng. Data, 1976 21(2), 228–32.
Liquid (melt) Heat Capacities and Heats of Vaporization of Oligomers of Poly(hesamethylene sebacate); J.C. Phillips; Polym. Eng. Sci., 1975, 15(2), 73–8.
Mass Spectra and Qualitative Analysis of Esters of Aliphatic Dicarboxylic Acids; L.N. Sosulina; Zh. Org. Khimm, 1974, 10(7), 1350–5.
Lubricants for Precision Mechanisms; A.K. Misra et al.; *Proc. World Conf. Ind. Tribol.,* 1973 New Lubricants. Esters and Polyesters of Pentaerythritol; Witold Pawlowski et al., Przem. Chem., 1974, 51(8).
Mixed Esters of 1,10–decanedicarboxylic acid; I.A. Volkova et al; Zh. Prikl, Knim. (Leningrad) 1972; 45(4).
Substances Contained in Polyesters of the System Triol–monool–dicarboxylic Acid; R. Schoellner; Plaste kaut, 1968, 15(3).
Light–switched Chromophoric Device Designed From an Ionophoric Calix[4]arene; Gang Deng et al.; J. Polym. Sci., Part a: Polym. Chem., 1993, 31(7).

Photoimaging Composition Containing Oligomer Maleic Acid Ester and Fumaric Acid Ester for Preparation of Relief Printing Plates; Joachim Gersdorf; Ger. Offen., 8 pp., Date Unknown.
Mixed Esters for Plasticizers for Poly(vinyl chloride); Tetsu Matsumoto; Jpn. Kokai Tokkyo Koho, 7pp., Date Unknown.
Diol Alkenyl Fumarates for Preparation of Highly Crosslinked Polymers; Tkayuki Otsu et al.; Jpn. Kokai Tokkyo Koho, 6, Date Unknown.
Diol Bis(alkyl fumaate) Compounds; Masayoshi Oiwa; Jpn. Kokai Tokkyo Koho, 7 pp. Date Unknown.
Polyol Poly(allylesters); Masaaki Oba et al.; Japan. Kokai, 4 pp., Date Unknown.
Complex Ester Plasticizers and Lubricants; Tetsu Matsumoto; Jpn. Kokai Tokkyo Koho, 11 pp., Date Unknown.

Effects of Small Amounts of the Plasticizer Propylene Glycol Adipate Dibutyl Ester on the High–speed Extrusion of Rigid PVC; H.R. Vargas et al.; Rev. Plast. Mod., 1986, 51(360).

Membrane Manufacturing Method; Inorganic Analytical Chemistry, Date Unknown.

Refrigerator Working Fluid Compositions; Fossil Fuels, Derivatives and Related Products, Date Unknown.

BLENDS OF LUBRICANT BASESTOCKS WITH HIGH VISCOSITY COMPLEX ALCOHOL ESTERS

This application claims benefit of Provisional application Ser. No. 60/025,596, filed Sept. 6, 1996.

The present invention relates generally to blends of lubricant basestocks with high viscosity complex alcohol esters. In particular, it relates to enhanced lubricant basestocks formed by blending (i) complex alcohol esters formed by reacting a polyol with a polycarboxylic acid or anhydride of a polycarboxylic acid, and a limited excess of monohydric alcohol, i.e., 0–20% excess alcohol, more preferably 0–15%, with other hydrocarbon-based, natural and/or synthetic basestocks. These blended basestocks, when additized with different adpacks, can achieve the specified properties of various end-use applications. When these high viscosity complex alcohol esters are blended with basestocks such as hydrocarbon-based oils, the following basestock performance improvements are achieved: desired viscosities for different iso grade lubricants; good engine performance such as fuel economy, wear, friction reduction, and increased load carrying ability; good low temperature properties; and improved seal compatibility. When the complex alcohol esters are blended with basestocks such as synthetic oils and natural oils such as rapeseed, then the following performance improvements are seen: wide range of viscosities for various iso-grade applications, good low temperature properties, excellent lubricity, seals' compatibility, good biodegradability, and very low toxicity.

BACKGROUND OF THE INVENTION

Lubricants in commercial use today are prepared from a variety of natural and synthetic basestocks admixed with various additive packages and solvents depending upon their intended application. The basestocks typically include mineral oils, highly refined mineral oils, poly alpha olefins (PAO), polyalkylene glycols (PAG), phosphate esters, silicone oils, diesters or polyol esters.

Synthetic lubricants provide a valuable alternative to natural lubricants in a wide variety of applications. A preferred synthetic lubricant is neopolyol esters which are formed from the esterification of neopolyols and monocarboxylic acids. Thus, for example, use of neopolyols such as neopentyl glycol, trimethylolethane, trimethylolpropane, monopentaerythritol, technical grade pentaerythritol, dipentaerythritol, tripentaerythritol and the like can be esterified with carboxylic acids ranging from formic acid, acetic acid, propionic acid, up through long chain carboxylic acids both linear and branched. Typically, the acids employed range from $C_5$ to $C_{22}$.

One typical method of production of polyol esters would be to react a neopolyol with a carboxylic acid at elevated temperatures in the presence or absence of an added catalyst. Catalysts such as sulfuric acid, p-toluene sulfonic acid, phosphorous acid, and soluble metal esterification catalysts are conventionally employed.

While the method of production of neopolyol esters as outlined above is well known, the method produces materials with a set of standard properties. For a given combination of neopolyol and acid (or mixtures thereof) there is a set of product properties such as viscosity, viscosity index, molecular weight, pour point, flash point, stability, polarity, and biodegradability which are inherent to the compositions formed by the components in the recipe. To get out of the box of viscosity and other properties imposed by structure, attempts have been made to increase the viscosity of neopolyol esters by means of a second acid, a polybasic acid, in addition to, or instead of, the monocarboxylic acids described above. Thus, employing a polybasic acid such as, e.g., adipic acid, sebacic acid, azelaic acid and/or acid anhydrides such as, succinic, maleic and phthalic anhydride and the like enables one to have the components of a polymeric system when reacted with a neopolyol. By adding a poly- or di-basic acid to the mix, one is able to achieve some degree of cross-linking and/or oligomerization, thereby causing molecular size growth such that the overall viscosity of the system is increased.

High viscosity oils (greater than 100 cSt at 40° C.) are desirable for two reasons: alone, in certain end use applications such as greases, heavy duty engine oils, certain hydraulic fluids and the like, and in blends with lower viscosity oils to achieve a wide viscosity range of products for various iso grades. Complex acid esters like those described above (i.e., esters produced using a polyol, a polybasic acid for cross-linking, and a monobasic acid for end-capping), however, have inherent problems such as high acid numbers and high cost.

An alternative to complex acid esters is complex alcohol esters (esters produced using a polyol, a polybasic acid, and a monohydric linear or branched alcohol for end-capping). With the right ratios of polyol to polybasic acid to monohydric alcohol, complex alcohol esters can be produced which have: reduced cost (approximately half the cost of complex acid esters), high viscosity (greater than 100 cSt at 40° C., good thermal and oxidative stability, good biodegradability, low toxicity, good low temperature properties, excellent lubricity. When blended with lower viscosity oils, a wide range of iso grade products can be produced which meet stringent end-use specifications. The present inventors have discovered that when the amount of linear monohydric alcohol exceed 20% of the total alcohol used, then the pour point is too high, e.g., above −30° C. Furthermore, the present inventors have discovered that the ratio of polybasic acid to polyol is critical in the formation of a complex alcohol ester. That is, if this ratio is too low then a complex alcohol ester contains undesirable amounts of heavies which reduces biodegradability and increases the hydroxyl number of the ester which increases the corrosive nature of the resultant ester which is also undesirable. If, however, the ratio is too high then the resultant complex alcohol ester will have an undesirably low viscosity (reducing its applicability in certain iso grade applications) and poor seal swell characteristics.

Other conventional natural and synthetic esters may each provide one or more of the desired attributes, e.g., high viscosity, good low temperature properties, biodegradability, lubricity, seal compatibility, low toxicity, and good thermal and oxidative stability, but none appears to be able to meet all of the product attributes by themselves. For example, some synthetic esters are capable of meeting the high viscosity property, but fail the biodegradability, low temperature requirements, or low toxicity requirements. Similarly, the natural basestocks such as rapeseed oil are capable of meeting the biodegradability and toxicity properties, but fail to meet the required high viscosity, lubricity, and thermal and oxidative stability properties.

The blended lubricant basestocks according to the present invention comprising a complex alcohol ester and at least one additional natural or synthetic basestock appear to satisfy all of the desired attributes for fully formulated lubricant basestocks by providing the basestock with a unique level of biodegradability in conjunction with effective lubricating properties. They also provide excellent thermal and oxidative stability, good low temperature properties (i.e., low pour points), low toxicity, low volatility, and good seal compatibility.

The complex alcohol esters with low adipate content according to the present invention is formed by using no more than 20% excess alcohol during the reaction step. Furthermore, the present inventors have discovered that these unique complex alcohol esters according to the present invention can also be formed such that they have low metals and acid content by treating the crude reactor product with water at elevated temperatures and pressures greater than one atmosphere. That is, the present inventors have unexpectedly discovered that high temperature hydrolysis can be used to remove a substantial portion of the metal catalyst from the complex alcohol ester reaction product without any significant increase in the total acid number of the resulting product. Low metal and low acid number are important because both can catalyze the hydrolysis of the ester during end-use.

Moreover, the present inventors have also demonstrated that an unexpected, synergistic effect occurs when these complex alcohol esters of the present invention are blended with either a natural or synthetic ester basestock, i.e., the blended basestock unexpectedly exhibits enhanced product attributes versus either the complex alcohol ester or other basestock by itself. Thus, the blended basestocks according to the present invention exhibit the following attributes: excellent lubricity, seal compatibility, biodegradability, low toxicity, good low temperature properties, a wide viscosity range to meet various iso grade needs, good thermal and oxidative stability, and improved engine performance.

SUMMARY OF THE INVENTION

A lubricating oil comprising an add mixture of the following components: (A) a complex alcohol ester basestock which comprises the reaction product of an add mixture of the following: a polyhydroxyl compound represented by the general formula:

$$R(OH)_n$$

wherein R is any aliphatic or cyclo-aliphatic hydrocarbyl group and n is at least 2, provided that the hydrocarbyl group contains from about 2 to 20 carbon atoms; a polybasic acid or an anhydride of a polybasic acid, provided that the ratio of equivalents of the polybasic acid to equivalents of alcohol from the polyhydroxyl compound is in the range between about 1.6:1 to 2:1; and a monohydric alcohol, provided that the ratio of equivalents of the monohydric alcohol to equivalents of the polybasic acid is in the range between about 0.84:1 to 1.2:1; wherein the complex alcohol ester exhibits a pour point of less than or equal to −20° C., a viscosity in the range between about 100–700 cSt at 40° C. and having a polybasic acid ester concentration of less than or equal to 70 wt. %, based on the complex alcohol ester; and (B) at least one additional basestock.

The lubricating oil according to the present invention preferably exhibits the following properties: excellent lubricity as determined by engine performance, vane pump tests, Yamaha Tightening Test, reduced valve sticking, or 4-ball wear; good stability as evidenced by the results of such tests as RBOT and Cincinnati Milacron; good low temperature performance, complete iso grade viscosity range for most end-uses, unexpected biodegradability as measured by the Sturm test (e.g., Modified Sturm test), no VOC's an low toxicity.

The present invention also includes a lubricant formed from the admixture of the aforementioned lubricating oil and appropriate additive packages, depending on the formulation's end-use. Because the basestock components make up 80 to 90+% of the total formulations, the present inventors have found that the above tests' results are either completely controlled or significantly influenced by the right choices of basestock components. In addition, the present inventors have found that with varying ratios of two primary components, namely, the polyol ester of technical grade pentaerythritol and 50:50 wt. % ratio of iso-$C_8$, n-$C_8$ and n-$C_{10}$ acids and complex alcohol esters, most of the current specifications can be met without the aid of any additive and that the remaining specifications are sol closely approached that only minimal additives are required to meet specifications.

The complex alcohol ester according to the present invention is preferable present in an amount between about 0.5 to 15 wt. % when the second basestock is predominantly a hydrocarbon-based oil (i.e., mineral oils or highly refined mineral oils) In these cases, the complex alcohol ester is added primarily for lubricity and usually replaces or significantly reduces a metal extreme pressure (EP) wear additive such as one of the ZDDP family. In addition to engine performance credits, the resulting formulation can have lower toxicity and lower costs and/or it can meet new industry specifications such as TC-W3 specifications in the two-cycle engine market.

When the additional basestock is a synthetic oil or natural oil (e.g., rapeseed oil, canola oil or sunflower oil), it is preferable that the complex alcohol ester be present in an amount between about 5 to 95 wt. %, depending on the desired viscosity of the final formulation (iso grade desired), and the natural or synthetic oil be present in such an amount to obtain the desired viscosity (5 to 95 wt. %). In these cases the complex alcohol ester is added primarily for its high viscosity (greater than 100 cSt at 40° C.) and biodegradability (greater than 60% by Modified Sturm). By using these two classes of components in varying concentrations, all desirable iso grades can be obtained, all of which are non-toxic and biodegradable. In addition, the over-all additive package can be formulated to minimize environmental impact due to the performance of the basestock blends. The resulting formulations offer equal or superior engine wear performance over existing formulations and little or no environmental impact.

DESCRIPTION OF THE PREFERRED EMBODIMENTS

High viscosity complex alcohol esters provide a unique level of biodegradability in conjunction with effective lubricating properties even at low concentrations (i.e., less than 5 wt. %). If the total acid number (TAN) and the di-ester content are low (i.e., less than 0.7 mgKOH/gram and less than 45 wt. %, respectively), and the esterification catalyst is effectively removed to a level of less than 10 ppm, high viscosity complex alcohol esters also provided excellent stability, good seal compatibility, and low toxicity. The present inventors have discovered that these unique high viscosity, low metals/low acid complex alcohol esters, when blended with other hydrocarbon-based, natural and/or synthetic basestocks, result in lubricant basestocks which exhibit enhanced engine wear performance greater than expected based on the measured performance of either basestock alone.

The preferred lubricant according to the present invention comprises: (A) a lubricant oil comprising a blend of the unique complex alcohol ester composition described herein and at least one additional basestock selected from the group consisting of: natural oils such as rapeseed oils, canola oils and sunflower oils; hydrocarbon-based oil such as mineral oils and highly refined mineral oils; and synthetic oils such as poly alpha olefins (PAO), polyalkylene glycols (PAG), polyisobutylene (PIB), phosphate esters, silicone oils, diesters, and polyol esters; and (B) a lubricant additive package. Blended lubricants according to the present invention preferably include 0.5 to 15 wt. % complex alcohol ester and 85 to 99.5 wt. % of a second basestock when the second basestock is predominantly a hydrocarbon-based oil. However, when the second basestock is either a natural or synthetic oil, then the blended lubricant comprises 5 to 95 wt. % complex alcohol ester and 5–95 wt. % natural or synthetic oil.

The complex alcohol ester basestock is added in an amount such that the lubricating oil exhibits a lubricity, as measured by the coefficient of friction, of less than or equal to 0. 15.

The lubricating oil according to the present invention preferably passes the Yamaha Tightening Test, exhibits a FZG of greater than about 12, and/or exhibits a wear scar diameter of less than or equal to 0.45 millimeters.

The additive package typically comprises at least one additive selected from the group consisting of: viscosity index improvers, corrosion inhibitors, oxidation inhibitors, dispersants, lube oil flow improvers, detergents and rust inhibitors, pour point depressants, anti-foaming agents, anti-wear agents, seal swellants, friction modifiers, extreme pressure agents, color stabilizers, demulsifiers, wetting agents, water loss improving agents, bactericides, drill bit lubricants, thickeners or gellants, anti-emulsifying agents, metal deactivators, coupling agents, surfactants, and additive solubilizers.

The lubricant according to the present invention is preferably selected from the group consisting of: crankcase engine oils, two-cycle engine oils, catapult oils, hydraulic fluids, drilling fluids, aircraft and other turbine oils, greases, compressor oils, functional fluids, gear oils, and other industrial and engine lubrication applications.

COMPLEX ALCOHOL ESTERS

One preferred complex alcohol ester according to the present invention the reaction product of an add mixture of the following: a polyhydroxyl compound represented by the general formula:

$$R(OH)_n$$

wherein R is any aliphatic or cyclo-aliphatic hydrocarbyl group and n is at least 2, provided that the hydrocarbyl group contains from about 2 to 20 carbon atoms; a polybasic acid or an anhydride of a polybasic acid, provided that the ratio of equivalents of the polybasic acid to equivalents of alcohol from the polyhydroxyl compound is in the range between about 1.6:1 to 2:1; and a monohydric alcohol, provided that the ratio of equivalents of the monohydric alcohol to equivalents of the polybasic acid is in the range between about 0.84:1 to 1.2:1; wherein the complex alcohol ester exhibits a pour point of less than or equal to −20° C., a viscosity in the range between about 100–700 cSt at 40° C., preferably 100–200 cSt, and having a polybasic acid ester concentration of less than or equal to 70 wt. %, based on the complex alcohol ester.

The present inventors have unexpectedly discovered that if the ratio of polybasic acid to polyol (i.e., polyhydroxyl compound) is too low, then an unacceptable amount of cross-linking occurs which results in very high viscosities, poor low temperature properties, poor biodegradability, and poor compatibility with other basestocks and with additives. If, however, the ratio of polybasic acid to polyol is too high, then an unacceptable amount of polybasic acid ester (e.g., adipate di-ester) is formed resulting in poor seal compatibility and low viscosity which limits the complex alcohol ester's applicability.

The present inventors have also discovered that if the ratio of monohydric alcohol to polybasic acid is too low, i.e., less than 0.96 to 1, then an unacceptably high acid number, sludge concentration, deposits, and corrosion occur. If, however, the ratio of monohydric alcohol to polybasic acid is too high (i.e., 1.2 to 1), then an unacceptable amount of polybasic acid ester is formed resulting in poor seal compatibility and low viscosity which limits the complex alcohol ester's applicability.

Moreover, the complex alcohol ester according to the present invention exhibits the following properties: lubricity, as measured by the coefficient of friction, of less than or equal to 0.1; a pour point of less than or equal to −30° C., preferably −40° C.; biodegradability of greater than 60%, as measured by the Sturm test (e.g., Modified Sturm test); an aquatic toxicity of greater than 1,000 ppm; no volatile organic components; and thermal/oxidative stability as measured by HPDSC at 220° C. and 3.445 MPa air of greater than 10 minutes.

When the polyhydroxyl compound is at least one compound selected from the group consisting of: technical grade pentaerythritol and mono-pentaerythritol, then the ratio of equivalents of the polybasic acid to equivalents of alcohol from the polyhydroxyl compound is in the range between about 1.75:1 to 2:1.

When the polyhydroxyl compound is at least one compound selected from the group consisting of: trimethylolpropane, trimethylolethane and trimethylolbutane, then the ratio of equivalents of the polybasic acid to equivalents of alcohol from the polyhydroxyl compound is in the range between about 1.6:1 to 2:1.

When the polyhydroxyl compound is di-pentaerythritol, then the ratio of equivalents of the polybasic acid to equivalents of alcohol from the polyhydroxyl compound is in the range between about 1.83:1 to 2:1.

The monohydric alcohol may be at least one alcohol selected from the group consisting of: branched and linear $C_5$ to $C_{13}$ alcohol. The linear monohydric alcohol is preferably present in an amount between about 0 to 30 mole %, more preferably between about 5 to 20 mole %.

In a preferred embodiment, the monohydric alcohol is at least one alcohol selected from the group consisting of: $C_8$ to $C_{10}$ iso-oxo alcohols. Accordingly, one highly preferred complex alcohol ester is formed from the reaction product of the admixture of trimethyloipropane, adipic acid and either isodecyl alcohol or 2-ethylhexanol.

The unique complex alcohol esters according to the present invention preferably exhibit at least one of the properties selected from the group consisting of: (a) a total acid number of less than or equal to about 1.0 mgKOH/gram, (b) a hydroxyl number in the range between about 0 to 50 mgKOH/gram, (c) a metal catalyst content of less than about 25 ppm, (d) a molecular weight in the range between about 275 to 250,000 Daltons, (e) a seal swell equal to about diisotridecyladipate, (f) a viscosity at −25° C. of less than or equal to about 100,000 cps, (g) a flash point of greater than about 200° C., (h) aquatic toxicity of greater than about 1,000 ppm, (i) a specific gravity of less than about 1.0, (j) a viscosity index equal to or greater than about 150, and (k) an oxidative and thermal stability as measured by HPDSC at 220° C. of greater than about 10 minutes.

It is particularly desirable to be able to control the stoichiometry in such a way so as to be able to manufacture the same product each time. Further, one wants to obtain acceptable reaction rates and to obtain high conversion with low final acidity and low final metals content. The present inventors have synthesized a composition and a method of production of that composition which provides a high viscosity oil having good low temperature properties, low metals, low acidity, high viscosity index, and acceptable rates of biodegradability as measured by the Modified Sturm test.

Of particular interest is the use of certain oxo-alcohols as finishing alcohols in the process of production of the desired materials. Oxo alcohols are manufactured via a process, whereby propylene and other olefins are oligomerized over a catalyst (e.g., a phosphoric acid on Kieselguhr clay) and then distilled to achieve various unsaturated (olefinic) streams largely comprising a single carbon number. These streams are then reacted under hydroformylation conditions using a cobalt carbonyl catalyst with synthesis gas (carbon monoxide and hydrogen) so as to produce a multi-isomer mix of aldehydes/alcohols. The mix of aldehydes/alcohols is then introduced to a hydrogenation reactor and hydrogenated to a mixture of branched alcohols comprising mostly alcohols of one carbon greater than the number of carbons in the feed olefin stream.

One particularly preferred oxo-alcohol is isodecyl alcohol, prepared from the corresponding $C_9$ olefin. When the alcohol is isodecyl alcohol, the polyol is trimethylolpropane and the acid is the $C_6$ diacid, e.g. adipic acid, a preferred complex alcohol ester is attained. The present inventors have surprisingly discovered that this complex alcohol ester, wherein the alcohol is a branched oxo-alcohol has a surprisingly high viscosity index of ca. 150 and is surprisingly biodegradable as defined by the Modified Sturm test. This complex alcohol ester can be prepared with a final acidity (TAN) of less than 0.7 mg KOH/gram and with a conversion of the adipic acid of greater than 99%. In order to achieve such a high conversion of adipic acid, a catalyst is required, and further, it is preferable to add the catalyst within a relatively narrow conversion window. Alternatively, the present inventors have discovered that the catalyst can also be added at anytime during the reaction product and removed to an amount of less than 10 ppm and still obtain a final acidity (TAN) of less than 0.7 mg KOH/gram, so long as the esterification reaction is followed by a hydrolysis step wherein water is added in an amount of between about 0.5 to 4 wt. %, based on crude esterification product, more preferably between about 2 to 3 wt. %, at elevated temperatures of between about 100 to 200° C., more preferably between about 125 to 175° C., and most preferably between about 140 to 160° C., and pressures greater than one atmosphere. Such high temperature hydrolysis can successfully remove the metals to less than 10 ppm without increasing the TAN to greater than 0.7 mgKOH/gram. The low metals and low acid levels achieved by use of this novel high temperature hydrolysis step is completely unexpected.

The present inventors have discovered that the actual product is a broad mix of molecular weights of esters and that, if so desired, an amount of diisodecyl adipate can be removed from the higher molecular weight ester via wipe film evaporation or other separation techniques if desired.

The present inventors have also discovered that highly stable complex alcohol esters can be produced that are resistant to viscosity increases during heating. This is accomplished by synthesizing complex alcohol esters with a low hydroxyl number by limiting the ratio of polybasic acid, polyol and monohydric alcohol. These highly stable complex alcohol esters exhibit no increase in viscosity when heated to temperatures above 200° C., while similar esters with high hydroxyl numbers increase in viscosity from 5 to 10% under similar conditions.

MONOHYDRIC ALCOHOLS

Among the alcohols which can be reacted with the diacid and polyol are, by way of example, any $C_5$ to $C_{13}$ branched and/or linear monohydric alcohol selected from the group consisting of: isopentyl alcohol, n-pentyl alcohol, isohexyl alcohol, n-hexyl alcohol, isoheptyl alcohol, n-heptyl alcohol, iso-octyl alcohol (e.g., 2-ethyl hexanol or iso-octyl alcohol), n-octyl alcohol, iso-nonyl alcohol, n-nonyl alcohol, isodecyl alcohol, and n-decyl alcohol; provided that the amount of linear monohydric alcohol is present in the range between about 0–20 mole %, based on the total amount of monohydric alcohol.

One preferred class of monohydric alcohol is oxo alcohol. Oxo alcohols are manufactured via a process, whereby propylene and other olefins are oligomerized over a catalyst (e.g., a phosphoric acid on Kieselguhr clay) and then distilled to achieve various unsaturated (olefinic) streams largely comprising a single carbon number. These streams are then reacted under hydroformylation conditions using a cobalt carbonyl catalyst with synthesis gas (carbon monoxide and hydrogen) so as to produce a multi-isomer mix of aldehydes/alcohols. The mix of aldehydes/alcohols is then introduced to a hydrogenation reactor and hydrogenated to a mixture of branched alcohols comprising mostly alcohols of one carbon greater than the number of carbons in the feed olefin stream.

The branched oxo alcohols are preferably monohydric oxo alcohols which have a carbon number in the range between about $C_5$ to $C_{13}$. The most preferred monohydric oxo alcohols according to the present invention include iso-octyl alcohol, e.g., Cekanoic™ 8 alcohol, formed from the cobalt oxo process and 2-ethylhexanol which is formed from the rhodium oxo process.

The term "iso" is meant to convey a multiple isomer product made by the oxo process. It is desirable to have a branched oxo alcohol comprising multiple isomers, preferably more than 3 isomers, most preferably more than 5 isomers.

Branched oxo alcohols may be produced in the so-called "oxo" process by hydroformylation of commercial branched $C_4$ to $C_{12}$ olefin fractions to a corresponding branched $C_5$ to $C_{13}$ alcohol/aldehyde-containing oxonation product. In the process for forming oxo alcohols it is desirable to form an alcohol/aldehyde intermediate from the oxonation product followed by conversion of the crude oxo alcohol/aldehyde product to an all oxo alcohol product.

The production of branched oxo alcohols from the cobalt catalyzed hydroformylation of an olefinic feedstream preferably comprises the following steps:

(a) hydroformylating an olefinic feedstream by reaction with carbon monoxide and hydrogen (i.e., synthesis gas) in the presence of a hydroformylation catalyst under reaction conditions that promote the formation of an alcohol/aldehyde-rich crude reaction product;

(b) demetalling the alcohol/aldehyde-rich crude reaction product to recover therefrom the hydroformylation catalyst and a substantially catalyst-free, alcohol/aldehyde-rich crude reaction product; and (c) hydrogenating the alcohol/aldehyde-rich crude reaction product in the presence of a hydrogenation catalyst (e.g., massive nickel catalyst) to produce an alcohol-rich reaction product.

The olefinic feedstream is preferably any $C_4$ to $C_{12}$ olefin, more preferably branched $C_7$ to $C_9$ olefins. Moreover, the olefinic feedstream is preferably a branched olefin, although a linear olefin which is capable of producing all branched oxo alcohols is also contemplated herein. The hydroformylation and subsequent hydrogenation in the presence of an alcohol-forming catalyst, is capable of producing branched $C_5$ to $C_{13}$ alcohols, more preferably branched Cg alcohol (i.e., Cekanoic™ 8), branched $C_9$ alcohol (i.e., Cekanoic™ 9), and isodecyl alcohol. Each of the branched oxo $C_5$ to $C_{13}$ alcohols formed by the oxo process typically comprises, for example, a mixture of branched oxo alcohol isomers, e.g., Cekanoic™ 8 alcohol comprises a mixture of 3,5-dimethyl hexanol, 4,5-dimethyl hexanol, 3,4-dimethyl hexanol, 5-methyl heptanol, 4-methyl heptanol and a mixture of other methyl heptanols and dimethyl hexanols.

Any type of catalyst known to one of ordinary skill in the art which is capable of converting oxo aldehydes to oxo alcohols is contemplated by the present invention.

POLYOLS

Among the polyols (i.e., polyhydroxyl compounds) which can be reacted with the diacid and monohydric alcohol are those represented by the general formula:

$$R(OH)_n$$

wherein R is any aliphatic or cyclo-aliphatic hydrocarbyl group (preferably an alkyl) and n is at least 2. The hydrocarbyl group may contain from about 2 to about 20 or more carbon atoms, and the hydrocarbyl group may also contain substituents such as chlorine, nitrogen and/or oxygen atoms. The polyhydroxyl compounds generally may contain one or more oxyalkylene groups and, thus, the polyhydroxyl compounds include compounds such as polyetherpolyols. The number of carbon atoms (i.e., carbon number, wherein the term carbon number as used throughout this application refers to the total number of carbon atoms in either the acid or alcohol as the case may be) and number of hydroxy groups (i.e., hydroxyl number) contained in the polyhydroxyl compound used to form the carboxylic esters may vary over a wide range.

The following alcohols are particularly useful as polyols: neopentyl glycol, trimethylolethane, trimethylolpropane, trimethylolbutane, mono-pentaerythritol, technical grade pentaerythritol, and di-pentaerythritol. The most preferred alcohols are technical grade (e.g., approximately 88% mono-, 10% di- and 1-2% tri-pentaerythritol) pentaerythritol, monopentaerythritol, di-pentaerythritol, and trimethylolpropane.

POLYBASIC ACIDS

Selected polybasic or polycarboxylic acids include any $C_2$ to $C_{12}$ diacids, e.g., adipic, azelaic, sebacic and dodecanedioic acids.

ANHYDRIDES

Anhydrides of polybasic acids can be used in place of the polybasic acids, when esters are being formed. These include succinic anhydride, glutaric anhydride, adipic anhydride, maleic anhydride, phthalic anhydride, nadic anhydride, methyl nadic anhydride, hexahydrophthalic anhydride, and mixed anhydrides of polybasic acids.

The complex alcohol ester composition according to the present invention can be used in the formulation of various lubricants, such as, crankcase engine oils (i.e., passenger car motor oils, heavy duty diesel motor oils, and passenger car diesel oils), two-cycle engine oils, catapult oil, hydraulic fluids, drilling fluids, aircraft and other turbine oils, greases, compressor oils, functional fluids, gear oils, and other industrial and engine lubrication applications. The lubricating oils contemplated for use with the polyol ester compositions of the present invention include both mineral and synthetic hydrocarbon oils of lubricating viscosity and mixtures thereof with other synthetic oils. The synthetic hydrocarbon oils include long chain alkanes such as cetanes and olefin polymers such as oligomers of hexene, octene, decene, and dodecene, etc. The other synthetic oils include (1) fully esterified ester oils, with no free hydroxyls, such as pentaerythritol esters of monocarboxylic acids having 2 to 20 carbon atoms, trimethylol propane esters of monocarboxylic acids having 2 to 20 carbon atoms, (2) polyacetals and (3) siloxane fluids. Especially useful among the synthetic esters are those made from polycarboxylic acids and monohydric alcohols.

In some of the lubricant formulations set forth above a solvent may be employed depending upon the specific application. Solvents that can be used include the hydrocarbon solvents, such as toluene, benzene, xylene, and the like.

The formulated lubricant according to the present invention preferably comprises about 60–99% by weight of at least one polyol ester composition of the present invention, about 1 to 20% by weight lubricant additive package, and about 0 to 20% by weight of a solvent.

CRANKCASE LUBRICATING OILS

The basestock blend can be used in the formulation of crankcase lubricating oils (i.e., passenger car motor oils, heavy duty diesel motor oils, and passenger car diesel oils) for spark-ignited and compression-ignited engines. The preferred crankcase lubricating oil is typically formulated using the basestock blend formed according to the present invention together with any conventional crankcase additive package. The additives listed below are typically used in such amounts so as to provide their normal attendant functions. Typical amounts for individual components are also set forth below. All the values listed are stated as mass percent active ingredient.

| ADDITIVE | MASS % (Broad) | MASS % (Preferred) |
|---|---|---|
| Ashless Dispersant | 0.1–20 | 1–8 |
| Metal detergents | 0.1–15 | 0.2–9 |
| Corrosion Inhibitor | 0–5 | 0–1.5 |
| Metal dihydrocarbyl dithiophosphate | 0.1–6 | 0.1–4 |
| Supplemental anti-oxidant | 0–5 | 0.01–1.5 |
| Pour Point Depressant | 0.01–5 | 0.01–1.5 |
| Anti-Foaming Agent | 0–5 | 0.001–0.15 |
| Supplemental Anti-wear Agents | 0–0.5 | 0–0.2 |
| Friction Modifier | 0–5 | 0–1.5 |
| Viscosity Modifier[1] | 0.01–6 | 0–4 |
| Basestock Blend | Balance | Balance |

The individual additives may be incorporated into a basestock in any convenient way. Thus, each of the components can be added directly to the basestock by dispersing or dissolving it in the basestock at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into basestock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 15 mass % and preferably 5 to 10 mass %, typically about 7 to 8 mass % of the concentrate or additive package with the remainder being basestock.

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, aminoesters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The viscosity modifier (VM) functions to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrenelbutadiene, and isoprene/butadiene, as well as the partially hydrogenated homopolymers of butadienc and isoprene and isoprene/divinylbenzene.

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as may be measured by ASTM D2896) of from 0 to 80. It is possible to include large amounts of a metal base by reacting an excess of a metal compound such as an oxide or hydroxide with an acidic gas such as carbon dioxide. The resulting overbased detergent comprises neutralized detergent as the outer layer of a metal base (e.g. carbonate) micelle. Such overbased detergents may have a TBN of 150 or greater, and typically of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450.

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

Oxidation inhibitors or antioxidants reduce the tendency of basestocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum containing compounds.

Friction modifiers may be included to improve fuel economy. Oil-soluble alkoxylated mono- and diamines are well known to improve boundary layer lubrication. The amines may be used as such or in the form of an adduct or reaction product with a boron compound such as a boric oxide, boron halide, metaborate, boric acid or a mono-, di- or trialkyl borate.

Other friction modifiers are known. Among these are esters formed by reacting carboxylic acids and anhydrides with alkanols. Other conventional friction modifiers generally consist of a polar terminal group (e.g. carboxyl or hydroxyl) covalently bonded to an oleophillic hydrocarbon chain. Esters of carboxylic acids and anhydrides with alkanols are described in U.S. Pat. No. 4,702,850. Examples of other conventional friction modifiers are described by M. Belzer in the "Journal of Tribology" (1992), Vol. 114, pp. 675–682 and M. Belzer and S. Jahanmir in "Lubrication Science" (1988), Vol. 1, pp. 3–26.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK. Patent Specification No. 1,560,830. Benzotriazoles derivatives also fall within this class of additives. When these compounds are included in the lubricating composition, they are preferably present in an amount not exceeding 0.2 wt % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers and polyalkylmethacrylates.

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

TWO-CYCLE ENGINE OILS

The basestock blend can be used in the formulation of two-cycle engine oils together with selected lubricant additives. The preferred two-cycle engine oil is typically formulated using the basestock blend formed according to the present invention together with any conventional two-cycle engine oil additive package. The additives listed below are typically used in such amounts so as to provide their normal attendant functions. The additive package may include, but is not limited to, viscosity index improvers, corrosion inhibitors, oxidation inhibitors, coupling agents, dispersants, extreme pressure agents, color stabilizers, surfactants, diluents, detergents and rust inhibitors, pour point depressants, antifoaming agents, and anti-wear agents.

The two-cycle engine oil according to the present invention can employ typically about 75 to 85% basestock blend, about 1 to 5% solvent, with the remainder comprising an additive package.

Examples of the above additives for use in lubricants are set forth in the following documents which are incorporated herein by reference: U.S. Pat. No. 4,663,063 (Davis), which issued on May 5, 1987; U.S. Pat. No. 5,330,667 (Tiffany, III et al.), which issued on Jul. 19, 1994; U.S. Pat. No. 4,740,321 (Davis et al.), which issued on Apr. 26, 1988; U.S. Pat. No. 5,321,172 (Alexander et al.), which issued on Jun. 14, 1994; and U.S. Pat. No. 5,049,291 (Miyaji et al.), which issued on Sep. 17, 1991.

CATAPULT OILS

Catapults are instruments used on aircraft carriers at sea to eject the aircraft off of the carrier. The basestock blend can be used in the formulation of catapult oils together with selected lubricant additives. The preferred catapult oil is typically formulated using the basestock blend formed according to the present invention together with any conventional catapult oil additive package. The additives listed below are typically used in such amounts so as to provide their normal attendant functions. The additive package may include, but is not limited to, viscosity index improvers, corrosion inhibitors, oxidation inhibitors, extreme pressure agents, color stabilizers, detergents and rust inhibitors, antifoaming agents, anti-wear agents, and friction modifiers. These additives are disclosed in Klamann, "Lubricants and Related Products", *Verlag Chemie*, Deerfield Beach, Fla., 1984, which is incorporated herein by reference.

The catapult oil according to the present invention can employ typically about 90 to 99% basestock blend, with the remainder comprising an additive package.

HYDRAULIC FLUIDS

The basestock blend can be used in the formulation of hydraulic fluids together with selected lubricant additives. The preferred hydraulic fluids are typically formulated using the basestock blend formed according to the present invention together with any conventional hydraulic fluid additive package. The additives listed below are typically used in such amounts so as to provide their normal attendant functions. The additive package may include, but is not limited to, viscosity index improvers, corrosion inhibitors, boundary lubrication agents, demulsifiers, pour point depressants, and antifoaming agents.

The hydraulic fluid according to the present invention can employ typically about 90 to 99% basestock blend, with the remainder comprising an additive package.

Other additives are disclosed in U.S. Pat. No. 4,783,274 (Jokinen et al.), which issued on Nov. 8, 1988, and which is incorporated herein by reference.

DRILLING FLUIDS

The basestock blend can be used in the formulation of drilling fluids together with selected lubricant additives. The preferred drilling fluids are typically formulated using the basestock blend formed according to the present invention together with any conventional drilling fluid additive package. The additives listed below are typically used in such amounts so as to provide their normal attendant functions. The additive package may include, but is not limited to, viscosity index improvers, corrosion inhibitors, wetting agents, water loss improving agents, bactericides, and drill bit lubricants.

The drilling fluid according to the present invention can employ typically about 60 to 90% basestock and about 5 to 25% solvent, with the remainder comprising an additive package. See U.S. Pat. No. 4,382,002 (Walker et al), which issued on May 3, 1983, and which is incorporated herein by reference.

Suitable hydrocarbon solvents include: mineral oils, particularly those paraffin base oils of good oxidation stability with a boiling range of from 200–400° C. such as Mentor 28®, sold by Exxon Chemical Americas, Houston, Tex.; diesel and gas oils; and heavy aromatic naphtha.

TURBINE OILS

The basestock blend can be used in the formulation of turbine oils together with selected lubricant additives. The preferred turbine oil is typically formulated using the basestock blend formed according to the present invention together with any conventional turbine oil additive package. The additives listed below are typically used in such amounts so as to provide their normal attendant functions. The additive package may include, but is not limited to, viscosity index improvers, corrosion inhibitors, oxidation inhibitors, thickeners, dispersants, anti-emulsifying agents, color stabilizers, detergents and rust inhibitors, and pour point depressants.

The turbine oil according to the present invention can employ typically about 65 to 75% basestock and about 5 to 30% solvent, with the remainder comprising an additive package, typically in the range between about 0.01 to about 5.0 weight percent each, based on the total weight of the composition.

GREASES

The basestock blend can be used in the formulation of greases together with selected lubricant additives. The main ingredient found in greases is the thickening agent or gellant and differences in grease formulations have often involved this ingredient. Besides the thickener or gellants, other properties and characteristics of greases can be influenced by the particular lubricating basestock and the various additives that can be used.

The preferred greases are typically formulated using the basestock blend formed according to the present invention together with any conventional grease additive package. The additives listed below are typically used in such amounts so as to provide their normal attendant functions. The additive package may include, but is not limited to, viscosity index improvers, oxidation inhibitors, extreme pressure agents, detergents and rust inhibitors, pour point depressants, metal deactivators, anti-wear agents, and thickeners or gellants.

The grease according to the present invention can employ typically about 80 to 95% basestock blend and about 5 to 20% thickening agent or gellant, with the remainder comprising an additive package.

Typical thickening agents used in grease formulations include the alkali metal soaps, clays, polymers, asbestos, carbon black, silica gels, polyureas and aluminum complexes. Soap thickened greases are the most popular with lithium and calcium soaps being most common. Simple soap greases are formed from the alkali metal salts of long chain fatty acids with lithium 12-hydroxystearate, the predominant one formed from 12-hydroxystearic acid, lithium hydroxide monohydrate and mineral oil. Complex soap greases are also in common use and comprise metal salts of a mixture of organic acids. One typical complex soap grease found in use today is a complex lithium soap grease prepared from 12-hydroxystearic acid, lithium hydroxide monohydrate, azelaic acid and mineral oil. The lithium soaps are described and exemplified in may patents including U.S. Pat. No. 3,758,407 (Harting), which issued on Sep. 11, 1973; U.S. Pat. No. 3,791,973 (Gilani), which issued on Feb. 12, 1974; and U.S. Pat. No. 3,929,651 (Murray), which issued on Dec. 30, 1975, all of which are incorporated herein by reference together with U.S. Pat. No. 4,392,967 (Alexander), which issued on Jul. 12, 1983.

A description of the additives used in greases may be found in Boner, "Modem Lubricating Greases", 1976, Chapter 5, which is incorporated herein by reference, as well as additives listed above in the other products.

COMPRESSOR OILS

The basestock blend can be used in the formulation of compressor oils together with selected lubricant additives. The preferred compressor oil is typically formulated using the basestock blend formed according to the present invention together with any conventional compressor oil additive package. The additives listed below are typically used in such amounts so as to provide their normal attendant functions. The additive package may include, but is not limited to, oxidation inhibitors, additive solubilizers, rust inhibitors/metal passivators, demulsifying agents, and anti-wear agents.

The compressor oil according to the present invention can employ typically about 80 to 99% basestock blend and about 1 to 15% solvent, with the remainder comprising an additive package.

The additives for compressor oils are also set forth in U.S. Pat. No. 5,156,759 (Culpon, Jr.), which issued on Oct. 20, 1992, and which is incorporated herein by reference.

GEAR OILS

The basestock blend can be used in the formulation of gear oils together with selected lubricant additives. The preferred gear oil is typically formulated using the basestock blend formed according to the present invention together with any conventional gear oil additive package. The additives listed below are typically used in such amounts so as to provide their normal attendant functions. The additive package may include, but is not limited to, extreme pressure agents and antiwear agents (i.e., friction modifiers), corrosion inhibitors, antifoam agents, demulsifiers, rust inhibitors and antioxidants. Depending on the basestock selected and multigrade viscosity range, pour-point depressants and viscosity modifiers may also be used.

The gear oil according to the present invention can employ typically about 72 to 99% basestock blend (preferably 90 to 99%) and 1 to 28% of an additive package (preferably 1 to 10%). Optionally, a solvent or diluent may also be added wherein the weight % of the basestock and/or additive package would be reduced accordingly.

It is extremely important in many lubricant applications such as aircraft turbine oils to provide a lubricant product which is thermally/oxidatively stable. One means of measuring relative thermal/oxidative stability in lubricants is via high pressure differential scanning calorimetry (HPDSC). In this test, the sample is heated to a fixed temperature and held there under a pressure of air (or oxygen) and the time to onset of decomposition is measured. The longer the time to decomposition, the more stable the sample. In all cases described hereafter, the conditions are as follows unless specifically noted otherwise: 220° C., 3.445 MPa (500 psi) air (i.e., 0.689 MPa (100 psi) oxygen and 2.756 MPa (400 psi) nitrogen), and the addition of 0.5 wt. % dioctyl diphenyl amine (Vanlube-1®) as an antioxidant.

EXAMPLE 1

Complex alcohol esters were made using both trimethylolpropane and technical grade pentaerythritol as the polyol, adipic acid as the polybasic acid and various $C_7$–$C_{13}$ monohydric alcohols, both linear and branched. During the reaction, the adipate di-ester was also formed. Some of these materials were wipefilmed to remove the adipate di-ester and some were not. The products were submitted for various tests.

One particularly surprising result was in regard to seal swell. Diisodecyladipate (DIDA) has been found to be particularly harsh on some seals. Samples containing as much as 40% DIDA demonstrated the same seal swell as samples of diisotridecyladipate (DTDA), which is used as a commercial lubricant today because of its low seal swell.

EXAMPLE 2

Table 1 below compares a variety of complex alcohol esters versus a conventional branched ester to demonstrate the increased biodegradability and thermal and oxidative stability of the complex alcohol esters according to the present invention.

TABLE 1

| Ester | Pour Point (° C.) | Viscosity at −25° C. (cps) | Viscosity at 40° C. (cSt) | Viscosity at 100° C. (cSt) | Viscosity Index | HPDSC OIT*** (min.) | Biodegradability (%) |
|---|---|---|---|---|---|---|---|
| TMP/AA/IDA | — | — | 165.7 | 21.31 | 152 | — | 67.23 |
| TMP/AA/n-C7* | −33 | 43500 | 155.6 | 18.22 | 131 | — | 80.88 |
| TPE/AA/IHA | — | — | 160.8 | 24.35 | 184 | 58.83 | 84.83 |
| TMP/iso-$C_{18}$ | −20 | 358000 | 78.34 | 11.94 | 147 | 4.29 | 63.32 |
| TMP/AA/n-C7** | −14 | solid | 27.07 | 5.77 | 163 | — | 78.84 |

**Complex alcohol ester made without stripping of the adipate
**This is a partial ester of TMP, adipic acid and a n-C7 acid wherein the adipate diester has been stripped out
***OIT denotes oxidation induction time (minutes until decomposition)
HPDSC denotes high pressure differential calorimetry
TMP is trimethylolpropane
AA is adipic acid
IDA is isodecyl alcohol
IHA is isohexyl alcohol
TPE is technical grade pentaerythritol
iso-$C_{18}$ is isostearate The branched acid ester and the complex alcohol ester formed without stripping exhibited undesirable pour points, i.e., −20 and −14° C., respectively, and undesirable viscosities at −25° C., i.e., 358,000 cps and a solid product, respectively.

EXAMPLE 3

Set forth below in Table 2 are various samples where the complex alcohol esters of the present invention were blended with various other polyol esters and then run through a Yamaha 2T test.

TABLE 2

(Lubricity Data)

| Ester Blend | Blend Ratio | Reference | Sample |
|---|---|---|---|
| TPE/C810/Ck8:TMP/7810 | 1:1 | 6.00 | 5.92 |
| TMP/AA/IDA:TMP/1770 | 2:3 | 5.54 | 5.18 |

C810 is a mixture of linear $C_8$ and $C_{10}$ acids.
Ck8 is an iso-octanoic acid form from the cobalt oxo process.
7810 is a mixture of n-$C_7$, n-$C_8$, and n$C_{10}$ acids.
1770 is a 70:30 mixture of n-$C_7$ and α-branched $C_7$, respectively.

EXAMPLE 4

The samples set forth below in Table 3 demonstrate that complex alcohol esters can exhibit good biodegradability, especially complex alcohol esters blended with other basestocks.

TABLE 3

| Ester/ Ester Blend | Viscosity @ 40° C. | Percent Biodegradable (Modified Sturm) |
|---|---|---|
| TMP/AA/IDA | 56.89 | 65.21 |
| TMP/AA/IDA:TMP/1770 | 25.26 | 77.40 |
| TMP/AA/IDA:TMP/1770 + DI | 43.36 | 68.90 |
| TMP/AA/n-C7 alcohol | 27.07 | 78.84 |
| TMP/AA/n-C7 alcohol (bottoms) | 155.60 | 80.88 |
| TMP/AA/INA | 115.00 | 60.26 |
| TMP/AA/INA | 137.30 | 57.81 |

1770 denotes a 70:30 mixture of n-$C_7$ and α-branched $C_7$, respectively.
DI denotes dispersant additive package.
INA denotes isononylalcohol.

What is claimed is:

1. A lubricating oil composition comprising an add mixture of the following components:

(A) a complex alcohol ester basestock which is a reaction product of an add mixture of the following: (1) a polyhydroxyl compound selected from the group consisting of neopentyl glycol, technical grade pentaerythritol, mono-pentaerythritol, di-pentaerythritol, trimethylopropane, trimethylolethane and trimethylobutane; (2) a $C_2$–$C_{12}$ polybasic acid or an anhydride of a $C_2$–$C_{12}$ polybasic acid, providing that the ratio of equivalents of said polybasic acid to equivalents of alcohol from said polyhydroxyl compound is in the range between about 1.6:1 to 2:1; and (3) a $C_5$–$C_{13}$ monohydric alcohol, provided that the ratio of equivalents of said monohydric alcohol to equivalents of said polybasic acid is in the range between about 0.84:1 to 1.2:1; wherein said complex alcohol ester exhibits a viscosity in the range between about 100–700 cSt at 40° C. and has a polybasic acid ester concentration of less than or equal to 70 wt. %, based on said complex alcohol ester; and (B) a lubricity enhancing amount of at least one additional basestock effective to exhibit a lubricity, as measured by the coefficient of friction of the lubricating oil composition, of less than or equal to 0.15.

2. The lubricating oil according to claim 1 wherein said additional basestock is selected from the group consisting of: rapeseed oils, canola oils, sunflower oils, mineral oils, highly refined mineral oils, poly alpha olefins, polyalkylene glycols, polyisobutylenes, silicone oils, and synthetic esters.

3. The lubricating oil according to claim 1 wherein said complex alcohol ester is reacted under conditions sufficient to exhibit the following properties: lubricity, as measured by the coefficient of friction, of not greater than 0.15; a pour point of less than or equal to −20° C.; biodegradability of greater than 60%, as measured by the Strum test; an aquatic toxicity of greater than 1,000 ppm; no volatile organic components; and thermal/oxidative stability as measured by HPDSC at 220° C. and 3.445 MPa air of greater than 10 minutes.

4. The lubricating oil according to claim 1 wherein said lubricating oil comprises the ester basestock and the additional basestock in sufficient amounts to pass the Yamaha Tightening Test, exhibit a FZG of greater than about 12, and/or exhibit a wear scar diameter of not greater than 0.45 millimeters.

5. The lubricating oil of claim 1, further comprising a lubricant additive package.

6. The lubricating oil according to claim 2, wherein said synthetic esters are selected from the group consisting of phosphate esters, diesters, and polyol esters.

7. The lubricating oil according to claim 2 wherein said complex alcohol ester is present in an amount between about 0.5–15 wt. % and said additional basestock is present in an amount between about 85–99.5 wt. %; provided that said additional basestock is primarily said mineral oil and/or said highly refined mineral oil.

8. The lubricating oil basestock according to claim 2 wherein said additional basestock is a synthetic ester basestock and wherein said complex alcohol ester is present in an amount between about 5–95 wt. % and said additional basestock is present in an amount between about 95–5 wt. %.

9. The lubricating oil according to claim 3 wherein said complex alcohol ester has a pour point of at greater than −40° C.

10. The lubricating oil according to claim 1 wherein said polyhydroxyl compound is at least one compound selected from the group consisting of: technical grade pentaerythritol and mono-pentaerythritol, and the ratio of equivalents of said polybasic acid to equivalents of alcohol from said polyhydroxyl compound is in the range between about 1.75:1 to 2:1.

11. The lubricating oil according to claim 1 wherein said polyhydroxyl compound is at least one compound selected from the group consisting of: trimethylolpropane, trimethylolethane and trimethylolbutane, and the ratio of equivalents of said polybasic acid to equivalents of alcohol from said polyhydroxyl compound is in the range between about 1.6:1 to 2:1.

12. The lubricating oil according to claim 1 wherein said polyhydroxyl compound is di-pentaerythritol and the ratio of equivalents of said polybasic acid to equivalents of alcohol from said polyhydroxyl compound is in the range between about 1.83:1 to 2:1.

13. The lubricating oil according to claim 1 wherein viscosity of said complex alcohol ester is in the range between about 100–200 at 40° C.

14. The lubricating oil according to claim 1 wherein said monohydric alcohol is at least one alcohol selected from the group consisting of: branched and linear $C_5$ to $C_{13}$ alcohol.

15. The lubricating oil according to claim 14 wherein said linear monohydric alcohol is present in an amount between about 0 to 30 mole %.

16. The lubricating oil according to claim 15 wherein said linear monohydric alcohol is present in an amount between about 5 to 20 mole %.

17. The lubricating oil according to claim 14 wherein said monohydric alcohol is at least one alcohol selected from the group consisting of: $C_8$ to $C_{10}$ iso-alcohols.

18. The lubricating oil according to claim 17 wherein said polybasic acid is adipic acid and said monohydric alcohol is either isodecyl alcohol or 2-ethylhexanol.

19. The lubricating oil according to claim 1 wherein said complex alcohol ester is reacted under conditions sufficient to exhibit at least one of the properties selected from the group consisting of:

(a) a total acid number of not greater than 1.0 mgKOH/gram, (b) a hydroxyl number in the range between about 0 to 50 mgKOH/gram, (c) a metal catalyst content of not greater than 25 ppm, (d) a molecular weight in the range between about 275 to 250,000 Daltons, (e) a seal swell equal to about diisotridecyladipate, (f) a viscosity at −25° of not greater than 100,000 cps, (g) a flash point of greater than about 200° C., (h) aquatic toxicity of greater than about 1,000 ppm, (i) a specific gravity of not greater than 1.0, (j) a viscosity index equal to or greater than about 150, and (k) an oxidative and thermal stability as measured by HPDSC at 220° C. of greater than about 10 minutes.

* * * * *